United States Patent [19]

Eriksson

[11] Patent Number: 4,986,340

[45] Date of Patent: Jan. 22, 1991

[54] METHOD FOR STIRRING AND/OR BRAKING OF MELTS AND A DEVICE FOR CARRYING OUT THIS METHOD

[75] Inventor: Jan E. Eriksson, Mörarp, Sweden

[73] Assignee: Asea Aktiebolag, Västerås, Sweden

[21] Appl. No.: 561,254

[22] Filed: Jul. 30, 1990

Related U.S. Application Data

[63] Continuation of Ser. No. 109,051, Oct. 16, 1987, abandoned.

[30] Foreign Application Priority Data

Oct. 20, 1986 [SE] Sweden ..... 8604456

[51] Int. Cl.[5] ..... B22D 27/02

[52] U.S. Cl. ..... 164/468; 164/504

[58] Field of Search ..... 164/468, 504, 420

[56] References Cited

U.S. PATENT DOCUMENTS

| | | | |
|---|---|---|---|
| 3,536,122 | 10/1970 | Willim | 164/437 |
| 4,005,743 | 2/1977 | Ueda | 164/437 |
| 4,495,984 | 1/1985 | Kollberg | 164/468 |
| 4,566,523 | 1/1986 | Vaubel | 164/420 |

OTHER PUBLICATIONS

Patent Abstracts of Japan, vol. 10, No. 216, (M-502) (2272), Jul. 29, 1986, (JP-A-61-52969).

Patent Abstract of Japan, vol. 8, No. 186, (M-320) (1623), Aug. 25, 1984, (JP-A-59-76647).

Patent Abstracts of Japan, vol. 4, No. 183, (M-47) (665), Dec. 17, 1980, (JP-A-55-130363).

Jacobi et al., "Reoxidation des Giessstrahls und Bildung des Einschlussbandes beim Knüppelstrangguss" in *Stahl und Eisen,* 104, (1984), No. 17, pp. 855-862.

*Primary Examiner*—Kuang Y. Lin

*Attorney, Agent, or Firm*—Watson, Cole, Grindle & Watson

[57] ABSTRACT

Melt fed to a continuous casting mold is slowed and spread by a magnetic field acting in the path of the inflowing melt stream. The magnetic field, which is either a static field powered by continuous current, a field powered by permanent magnets, or a field powered by low-frequency alternating current, is applied at at least two spaced-apart locations, either in two separated cast strands or at spaced locations across a wide single strand.

9 Claims, 1 Drawing Sheet

19
13
13b
12
$V_D$
B
$V_C$
14
11
18
$V_B$
B
13a
$V_A$ 22
21
20

13b
13
19
12
$V_D$
B
$V_C$
14
11
18
$V_B$
B
13a
$V_A$ 13
19
13b
17
17
14
15
15
16
16
18
13a

METHOD FOR STIRRING AND/OR BRAKING OF MELTS AND A DEVICE FOR CARRYING OUT THIS METHOD

This is a continuation of Ser. No. 109,051 filed on Oct. 16, 1987, now abandoned.

TECHNICAL FIELD

The present invention relates to a method for slowing down and spreading incoming melt fed to a mold of a continuous casting plant. The invention thus improves the homogenity of the non-solidified parts of a cast strand being generated in one or more molds from a tapping jet of molten material entering the respective mold directly or via a casting pipe. In carrying out the method, a magnetic field is arranged to extend across the path of the incoming melt or tapping jet and acts to modify the flow pattern of the material in the tapping jet as it flows into the rest of the melt in the mold. The invention also relates to a device for carrying out this method.

DISCUSSION OF PRIOR ART

U.S. Pat. No. 4,495,984 (Kollberg) discloses a method for stirring the non-solidified parts of a cast strand of metallic material formed in a mold. Melt in the form of a tapping jet enters the mold directly or via a casting pipe. The path of the tapping jet in the mold is arranged to pass through a static magnetic field produced by a permanent magnet or created by a flowing electrical direct current. When the metallic melt passes through this magnetic field, the velocity of the tapping jet is reduced, the tapping jet being divided so that the effect of its impact on the rest of the melt in the mold is at least weakened. This prior art method addresses the previous problem that an energetic tapping jet penetrating deeply into the melt in the mold increases the risk of slag particles being deposited along the sides of the strand, thus becoming trapped in the cast strand and making the separation of slag by its drifting up towards the upper surface of the melt more unlikely.

SUMMARY OF THE INVENTION

One aspect of the present invention is an improvement of the method disclosed in Kollberg's U.S. Pat. No. 4,495,984 and is characterized in that the magnetic field (which can be a static field created by a flowing direct current, or the field of a permanent magnet, or a moving field powered by low frequency alternating current) is applied at two spaced-apart locations in the melt, either respective locations in two separated cast strands or two spaced-apart locations in a single wide strand. A further aspect of the invention relates to a device for carrying out this method, which device comprises at least one open-bottomed mold in a continuous casting machine (optionally with a casting pipe) which is characterized in that at each of at least two separated locations in the mold(s) magnetic pole pairs are arranged for the application of a magnetic field across the tapping jet. The magnetic field conducted through the pole pairs can be created by means of permanent magnets or by DC-powered or low frequency AC-powered coils with iron cores connected to the respective pole pairs.

In the manner described above, a considerably increased production can be obtained from a continuous casting plant in relation to that obtainable with the prior art tapping jet brake In addition, when employing the invention, it will be possible to utilize in a more rational way the magnetic circuits which are used.

BRIEF DESCRIPTION OF THE DRAWING

The invention will be exemplified in greater detail in the accompanying drawing, wherein.

DESCRIPTION OF PREFERRED EMBODIMENTS

Figure 1B:
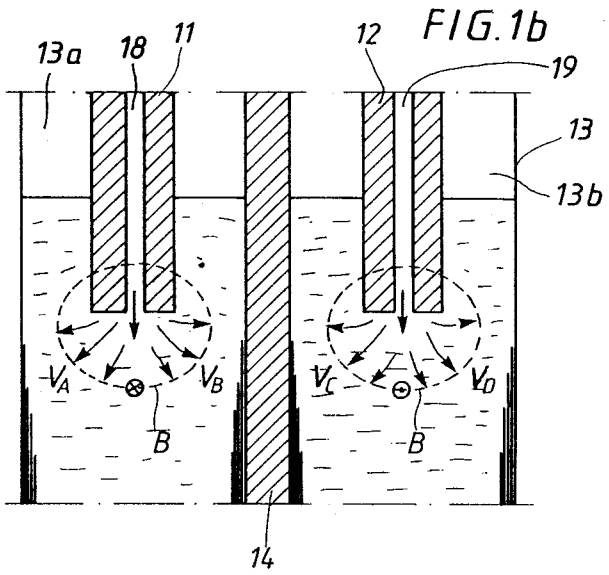
FIGS. 1*a* and 1*b* show in schematic sectional views a mold with a partition and provided with two casting pipes.
Figure 1A:
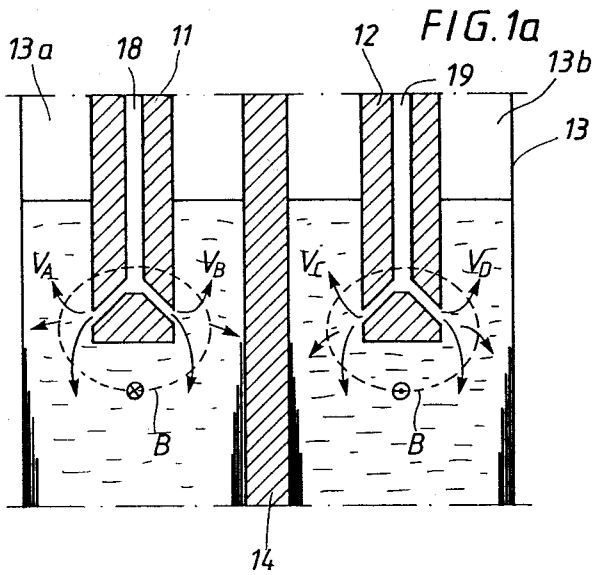

FIGS. 1*a* and 1*b* each show a cross-sectional view through an associated pair of mold parts 13*a*, 13*b* located side-by-side in a casting mold 13. The mold 13 is divided by a partition 14 to delimit the mold parts 13*a*, 13*b*, but such a partition is not essential and the invention can be applied to one wide mold 13. Two casting pipes 11, 12, lead into the mold parts and conduct melt from a ladle or an intermediate container (not shown) down into the mold parts. Each casting pipe 11, 12 is provided with a central feed channel 18, 19 for the downwardly flowing melt coming from the upstream container. Each feed channel 18, 19 leads to one, two or more outlet channels which may be obliquely upwardly-directed, horizontal, obliquely downwardly-directed, or vertical peripheral channels.

Figure 2:
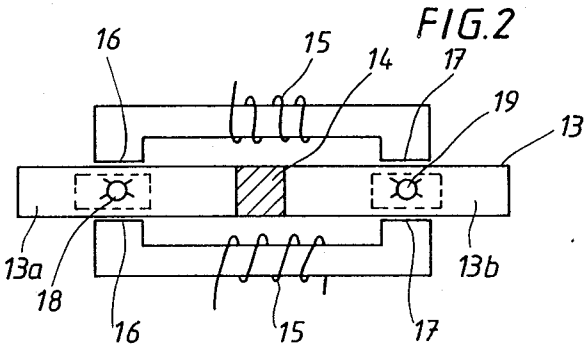
FIG. 2 is a cross-section of FIG. 1*a*.

Pole pairs 16 and 17 respectively, are arranged around the mold 13, on opposite sides of the longitudinal sides thereof (see FIG. 2), and are linked to form a magnetic circuit which creates a magnetic field acting transversely to the melt flow in the tapping jets flowing in the feed channels 18, 19. The pole pairs 16, 17 are intended to split and retard the melt flows defining the tapping jets and prevent slag deposits collecting on the inside of the solidified shell of melt in the mold 13, remelting of solidified regions, or other drawbacks. As will be clear from FIGS. 1*a* and 1*b*, the magnetic fields are arranged to act transversely to the outlet jets leaving the respective casting pipe 11, 12. However, in the case of direct tapping into the mold, i.e., without the use of a casting pipe, the magnetic field is located to act on the point where the incoming melt stream penetrates into the melt in the mold. The principal directions of the magnetic field are clear from the designations ⊙ and ⊗ shown on the dash lines B in FIGS. 1*a* and 1*b*, the field creating means is arranged such that the magnetic fields are directed transversely to each tapping jet.

In the method according to this invention melt is thus tapped into the mold (with or without the use of a casting pipe), the tapping jet being slowed down by means of the magnetic field and being broadened out (or divided) as is clear from the arrows $V_A$, $V_B$, $V_C$ and $V_D$ in FIGS. 1*a* and 1*b*. The pole pairs 16, 17 are suitably arranged such that the lowest velocity of input flow is obtained near the short sides of the mold 13 and/or such that the depth of penetration of the tapping jet or flow into the melt is as small as possible. Adjustments of velocity and direction of flow can be made by means of mutual displacements of the poles 16, 17 making up each pair, and/or by means of certain relative angular adjustments thereof. These can be empirically set for each particular case for the purpose of obtaining the lowest melt velocity along the short sides of the mold.

This is the most appropriate way of preventing deposits on, or melting of, the inside of the solidified shell in the mold. The partition 14 used to separate the cast strands, may for example, be a cooled copper body (see FIGS. 1*a*, 1*b*, 2), and the intention of using such a body is, of course, to create two separated cast strands. The magnetic circuit, which either contains permanent magnets or iron cored electromagnetic coils is connected to the respective pole pairs 16, 17. In the electromagnetic case, a coil or coils 15 is/are supplied with direct current to create a static field, or with a low frequency alternating current to create a moving field. The frequency used is suitably less than 0.1 Hz, for example 0.01 Hz. Whether the field be static or moving, its purpose is to bring about a spreading out or diffusing of the tapping jets. The magnetic field strength at the tapping jets can be in the range 1000 to 4000 gauss (0.1–0.4 tesla).

Figure 3:
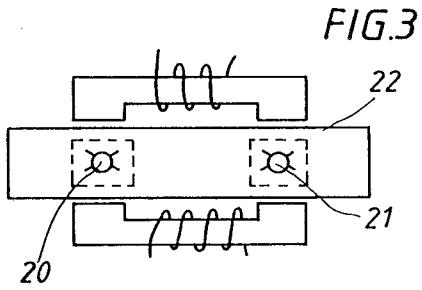
FIG. 3 is an alternative embodiment without partition.

FIG. 3 shows, in plan, an alternative embodiment, in which a single broad cast strand is fed by two spaced apart tapping jets 20 and 21. No partition 14 is used here, but the principle of spreading and retarding the incoming melt flows is exactly the same in the arrangement shown in FIG. 3 as applied in the arrangement shown in FIGS. 1*a*, 1*b* and 2. Thus, in the method according to FIG. 3, the melt flows are spread out and braked, and deposits on, and/or melting of, the solidified shell are prevented. The mold is shown in outline at 22 in FIG. 3.

The method and the device according to the foregoing description can be varied in many ways within the scope of the following claims.

What is claimed is:

1. A method of slowing down and spreading the non-solidified parts of tapping jets of molten materials flowing into a metallic melt in an open-bottomed mold from first and second spaced apart, downwardly-extending casting pipes, each of said casting pipes defining a flow channel through which molten material flows and a lower end having at least one orifice through which molten material flows as a tapping jet into said metallic melt, said method comprising positioning two iron cores which have first and second pole shoes at their opposite ends and which each have at least one coil from an electrical circuit wrapped therearound at opposite ends of said casting mold such that the first pole shoes of said two iron cores are directed at the lower end of said first casting pipe and the second pole shoes of said two iron cores are directed at the lower end of said second casting pipe, and passing an electrical current through said electrical circuit such that a magnetic field created between corresponding pairs of said first and second pole shoes acts on the molten material passing through the flow channel of aid first and second casting pipes and causes each tapping jet from each of said first and second casting pipes to slow down and spread out as it moves through a said orifice and enters said metallic melt.

2. A method according to claim 1, wherein said electrical current is a direct current.

3. A method according to claim 1, wherein said electrical current is a low frequency alternating current.

4. A method according to claim 1, wherein the magnetic fields are directed such that the smallest velocity of each tapping jet of molten metal is obtained where the jet is closest to a wall of the casting mold.

5. A method according to claim 1, in which the magnetic field strength lies in the range of 1000 to 4000 gauss.

6. A method according to claim 3, wherein said low frequency alternating current has a frequency less than 0.1 Hz.

7. An apparatus for supplying molten material to a metallic melt in an open-bottomed mold, said apparatus comprising first and second spaced apart casting pipes which extend downwardly into the metallic melt, each of said casting pipes defining a flow channel through which molten material flows and a lower end having at least one orifice through which molten material flows as a tapping jet into said metallic melt, two iron cores positioned at opposite sides of said casting mold, each iron core having first and second pole shoes at opposite ends thereof, the first pole shoe of each of said two iron cores being directed at the lower end of said first casting pipe and the second pole shoe of each of said two iron cores being directed at the lower end of said second casting pipe, at least one coil of an electrical circuit wrapped around each of said iron cores, and means for supplying electrical current to said electrical circuits so as to generate a magnetic field between the corresponding first and second pole shoes of said two iron cores and thereby cause the magnetic field to act on the molten material passing through the flow channel of said first and second casting pipes and cause each tapping jet from each of said first and second casting pipes to slow down and spread out as it moves into the metallic melt in said casting mold.

8. An apparatus for providing two cast strands, said apparatus comprising an elongated, open-bottomed molding containing a metallic melt and having a vertical partition therein to define two molding areas for providing two cast strands, first and second casting pipes located on opposite sides of said vertical partition and which respectively extend downwardly into the metallic melt in said two molding areas, each of said casting pipes defining a flow channel through which molten material flows and a lower end having at least one orifice through which molten material flows as a tapping jet into said metallic melt, two iron cores positioned at opposite sides of said casting mold, each iron core having first and second pole shoes at opposite ends thereof, the first pole shoe of each of said two iron cores being directed at the lower end of said first casting pipe and the second pole shoe of each of said two iron cores being directed at the lower end of said second casting pipe, at least one coil of an electrical circuit wrapped around each of said iron cores, and means for supplying electrical current to said electrical circuits so as to generate a magnetic field between the corresponding first and second pole shoes of said two iron cores and thereby cause the magnetic field to act on the molten material passing through the flow channel of said first and second casting pipes and cause each tapping jet from each of said first and second casting pipes to slow down and spread out as it moves into the metallic melt in said molding areas.

9. An apparatus according to claim 8, wherein said partition is a cooled copper body.

* * * * *